US010502036B2

(12) United States Patent
Spring

(10) Patent No.: US 10,502,036 B2
(45) Date of Patent: Dec. 10, 2019

(54) PERFORATING GUN SYSTEM

(71) Applicant: Schlumberger Technology Corporation, Sugar Land, TX (US)

(72) Inventor: Christian C. Spring, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 344 days.

(21) Appl. No.: 15/189,056

(22) Filed: Jun. 22, 2016

(65) Prior Publication Data

US 2017/0009559 A1 Jan. 12, 2017

Related U.S. Application Data

(60) Provisional application No. 62/189,020, filed on Jul. 6, 2015.

(51) Int. Cl.

| | |
|---|---|
| ***E21B 43/1185*** | (2006.01) |
| ***E21B 47/12*** | (2012.01) |
| ***E21B 47/14*** | (2006.01) |
| ***E21B 43/117*** | (2006.01) |

(52) U.S. Cl.

CPC ..... *E21B 43/1185* (2013.01); *E21B 43/117* (2013.01); *E21B 47/122* (2013.01); *E21B 47/14* (2013.01)

(58) Field of Classification Search

CPC .. E21B 43/117; E21B 43/1185; E21B 47/122; E21B 47/14; E21B 43/116

USPC ..... 89/1.15

See application file for complete search history.

(56) References Cited

U.S. PATENT DOCUMENTS

| | | | | |
|---|---|---|---|---|
| 5,052,489 | A * | 10/1991 | Carisella | E21B 43/1185 166/297 |
| 6,105,688 | A | 8/2000 | Vaynshteyn et al. | |
| 6,173,772 | B1 | 1/2001 | Vaynshteyn | |
| 7,913,603 | B2 * | 3/2011 | LaGrange | E21B 43/1185 166/373 |
| 8,091,477 | B2 | 1/2012 | Brooks et al. | |
| 2008/0156217 | A1 * | 7/2008 | Stewart | F42D 1/05 102/301 |
| 2011/0176387 | A1 * | 7/2011 | Froelich | E21B 47/16 367/82 |
| 2015/0096752 | A1 * | 4/2015 | Burgos | E21B 43/1185 166/297 |

(Continued)

OTHER PUBLICATIONS

Lynch, Utilising Acoustic Communication to Create Great TCP Technologies, APPS-13-10, Kuala Lumpur 2013, GeoKey LTD, (25 pages).

*Primary Examiner* — David J Bagnell
*Assistant Examiner* — Manuel C Portocarrero
(74) *Attorney, Agent, or Firm* — Cameron R. Sneddon

(57) ABSTRACT

A system and methodology are provided for improving the triggering (firing) of perforating guns, such as perforating guns deployed downhole via tubing. According to an embodiment, a methodology is provided for dependably communicating with an electronic firing head. The electronic firing head receives signals via wireless telemetry, such as either electromagnetic or acoustical telemetry. The methodology prevents surface or off depth detonation of the perforating guns by utilizing a fire command protocol.

18 Claims, 1 Drawing Sheet

(56) References Cited

U.S. PATENT DOCUMENTS

2015/0369956 A1* 12/2015 Ma ..... E21B 47/12
250/269.7

* cited by examiner

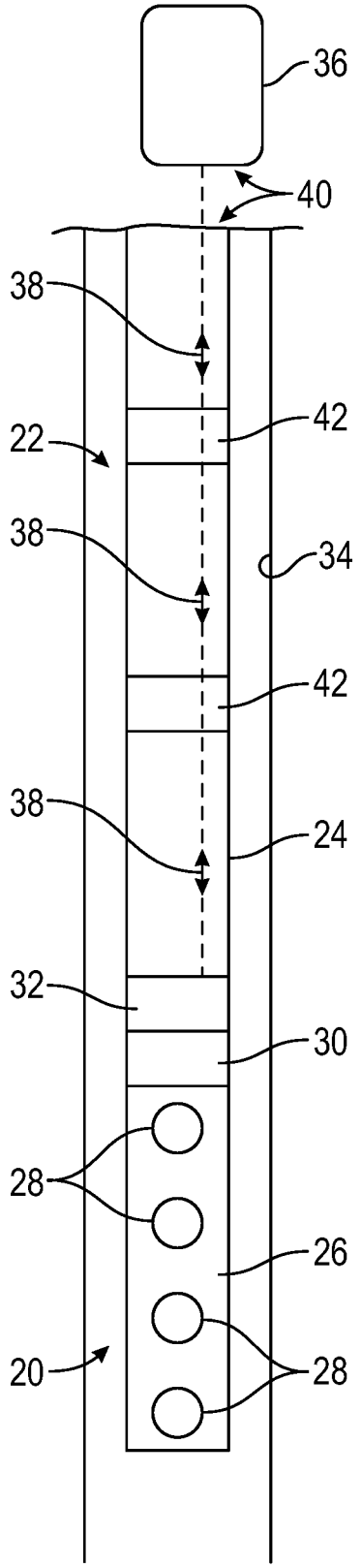
36
40
38
42
22
38
34
42
38
24
32
30
28
26
20
28

PERFORATING GUN SYSTEM

CROSS-REFERENCE TO RELATED APPLICATIONS

This application claims the benefit of U.S. Provisional Application No. 62/189020 filed Jul. 6, 2015.

BACKGROUND

An oil well comprises an earth borehole which may be lined with casing or liner that is bonded to the earth formation with cement. Perforating of an Oil/Gas well refers to the process of punching holes through the casing or liner and into the surrounding reservoir with a perforating gun. The holes or perforations are formed in a desired reservoir zone to connect the reservoir with the interior of the casing or liner. Generally, a perforating gun comprises a tube or pipe containing a series of shaped charges which, when detonated, causes the perforations through the casing or liner. Several mechanisms are available for deploying perforating guns, including electric line, slickline, coiled tubing, and other tubing. Perforating guns may be triggered (fired) with a firing head.

Various methods have been used to set off perforating guns deployed by tubing. For example, several methods have been employed for triggering firing heads and examples of those methods include drop bar activation, over pressure commands, differential pressure commands, and pressure pulse commands. Pressure pulse commands may be used with electronic firing heads. According to other relatively new methods either ultra-low frequency electromagnetic or acoustical telemetry techniques have been used for communicating with an electronic firing head(s).

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and:

FIG. 1 is a schematic illustration of a perforating gun assembly deployed in a wellbore via a tubing string and utilizing an electronic firing head configured to receive fire commands via a fire command protocol which prevents surface or off depth detonation, according to an embodiment of the disclosure.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In general, a system and methodology are provided for improving the triggering (firing) of perforating guns, such as perforating guns deployed downhole via tubing. According to an embodiment, a methodology is provided for dependably communicating with an electronic firing head that uses wireless telemetry, such as either electromagnetic or acoustical telemetry. The methodology prevents surface or off depth detonation of the perforating guns by utilizing a fire command protocol.

However, many modifications are possible without materially departing from the teachings of this disclosure. Accordingly, such modifications are intended to be included within the scope of this disclosure as defined in the claims.

According to an embodiment, a system and methodology are provided for improving the triggering (firing) of perforating guns. In a given application, a perforating gun may be part of a perforating gun assembly deployed downhole via tubing, such as coiled tubing or other suitable tubing. According to an embodiment, a methodology is provided for dependably communicating via wireless telemetry with an electronic firing system of an electronic firing head coupled into the perforating gun assembly. Examples of suitable wireless telemetry include either electromagnetic or acoustical telemetry. The methodology utilizes a unique fire command protocol which prevents surface or off depth detonation of the shaped charges positioned along the perforating gun.

As described in greater detail below, a procedure for ensuring desired firing of the perforating gun may include use of dongle key, password, and/or at least two fire commands to fire. In general, a dongle key is an electronic key that contains a unique serial number, and the key may be plugged into a serial port, e.g. a USB port, of a surface control system. However, the dongle key also may be in the form of other types of keys that are to be connected, plugged in, or otherwise installed. Examples include memory sticks, e.g. thumb drives, external hard discs, or an additional PC, CD, or DVD containing the appropriate serial number or identification software. Simple dongles, smart dongles with memory, memory sticks, CDs, DVDs, external hard drives, and second PCs can be used as a digital key if the correct serial number or software/firmware is installed. In an example, each fire command is unique and the first fire command is either confirmed by bidirectional communication or separated in time for a predefined period for monodirectional communication before the second fire command is sent.

If there are digital components that have memory, e.g. surface acquisition/control computers and repeaters, those components are configured to flush the previous fire command before the next one can be sent. In other words, no digital system with memory that is not a firing head contains or holds more than one firing command at the same time. The electronic firing head is the exception that it is configured to hold the fire commands for a limited or predefined time before going safe. Thus, a fire command protocol is provided which has an orderly fail-safe shutdown if a human mistake or hardware failure occurs.

Referring generally to FIG. 1, an example of a perforating gun assembly 20 is illustrated as deployed in a wellbore 22 via a tubing string 24. In this embodiment, the perforating gun assembly 20 comprises a perforating gun 26 having a plurality of shaped charges 28. The perforating gun 26 utilizes an electronic firing head 30 configured to receive fire commands via an electronic firing system 32. The electronic firing head 30/electronic firing system 32 may be referred to as an eFire system and operates according to a fire command protocol which prevents surface or off depth detonation. The perforating gun assembly 20 is illustrated as deployed downhole in the wellbore 22 which, in this example, is lined with a suitable liner or casing 34.

The electronic firing head 30 may be configured to initiate firing of the perforating gun(s) 26 upon receipt of appropriate wireless commands from a control system 36. By way of example, the control system 36 may be located at the surface. In embodiments described herein, the wireless commands may be conveyed via, for example, electromagnetic or acoustical signals 38 conveyed by a wireless telemetry system 40. In this example, the electronic firing head 30/electronic firing system 32 and the control system 36 may be part of the wireless telemetry system 40. In some applications, a series of repeaters 42 may be employed along the tubing string 24 to enhance transmission of the wireless signals 38 over substantial distances along wellbore 22.

A conventional electronic firing head is generally battery-powered and provides a fail-safe design by using multiple microprocessor/microcontrollers, multiple switches, watchdog timers, when go to watchdog timers, and/or other redundancies. However, wireless communication system hardware is not designed with hardware redundancy or fail-safes in mind. From a historical perspective, wireless electronic firing simply utilizes an electronic firing system with a pressure head that includes a MODEM. The MODEM may be either electromagnetic (Ultra Low Frequency Radio) or acoustical (Audio 500 Hz to 10 kHz). As of today, electronic firing systems may have a pressure head, a slick-line head, a differential pressure head and wireline head; and sometimes either an electromagnetic/ground current or acoustical head.

With respect to wireless eFire, current MODEM system hardware has not been designed with hardware redundancy or fail-safes in mind. According to embodiments described herein, wireless eFire is able to provide safety comparable to conventional eFire systems. In embodiments described herein, fail-safe features are incorporated in firmware, software, and procedure. By way of example, the fire command protocols described herein may be utilized with wireless eFire systems, such as acoustical or electromagnetic communication systems and services.

To prevent surface system and MODEM repeater hardware from transmitting a fire command at the wrong time, incomplete fire commands, e.g. half fire commands, are stored in the command file in the pieces of equipment that have a microprocessor with memory. The incomplete fire command rule is to prevent hardware with a microcontroller and memory from waking up from an intermittent failure and starting to retransmit a fire command. This approach also satisfies applicable API standards, such as the RP67 Standard which sets forth that two actions are to be taken to initiate perforating guns. API RP67 standard is the recommended practice for oilfield explosives safety.

In procedures described below, the operator uses a dongle; is limited to password access, and/or uses at least a two (2) digit prefix/pin code to send a fire command. If the password directly controls fire command, then prefix/pin codes may not be needed. In some applications, the procedure also obligates the operator to enter the correct gun position address and eFire serial number. A final fire command word may be derived or calculated from these inputs.

According to the fire command protocol for firing a gun, two actions are to be performed to enable firing of the gun. Sending two unique fire commands with a specified time delay between the first and the second command as well as a time out window for command completion provides a desired fail-safe. In this example, each fire command is unique and the first fire command may be confirmed by bidirectional communication or separated in time for a predefined period for mono-directional communication for the second fire command is sent.

A method for communicating with an electronic firing head(s) 30 is by a MODEM. MODEM is short for modulator-demodulator and is a device which enables a controller or computer to transmit and receive digital data through a medium. The medium of propagation can be, for example, either electromagnetic (Ultra Low Frequency Radio—0.1 Hz to 10 Hz) or acoustical (Audio 500 Hz to 10 kHz).

Bidirectional communication allows the surface operator to communicate with the electronic firing head 30 through the control system 36, and sometimes through repeaters 42, to the MODEM of the electric firing system 32 that is connected to or integrated with the electronic firing head 30. The firing head 30 can respond back and can confirm the state of the electronic firing head 30 through the same pathway before firing the guns 26.

Mono-directional communication also allows the surface operator to communicate with the electronic firing head 30 through the control system 36, and sometimes through repeaters 42, to the MODEM that is connected to the electronic firing head 30. In this embodiment, however, the firing head 30 does not respond back through the same pathway before firing the guns 26. The feedback to the control system 36 that the electronic firing head 30 has indeed received the fire commands is the actual detonation of the guns 26.

In some embodiments, feedback from the electronic firing head 30 is a useful feature to have in case of a malfunction or abortion of the firing sequence. If for whatever reason the gun string is to be removed from the well with unfired guns, knowing the status of the firing head is a helpful feature.

Although aspects of the fire command protocol for wireless electronic firing of the perforating gun may vary according to the parameters of a given application, an example is provided below for providing the desired fail-safes. According to this embodiment, a fire command protocol is provided for an oil well perforating gun wireless electronic firing head system as described below in the numbered sections. By way of example, the fire command protocol comprises:

1. A wireless fire command has two unique fire command words that are not used elsewhere and cannot be confused with other commands in the system. Command transmission has error checking and the minimum command word width is 32 bits in this example.
2. Wireless eFire provides a selective firing system with addressing based on gun position (MODEM Address) and eFire unique serial number.
3. The complete fire command words are not permanently stored in the surface equipment, repeater, hub, or eFire MODEM board except in a "write only" history log.
4. The first fire command word is forwarded or used, then flushed from the system command file—surface equipment, repeater, hub, or eFire MODEM board—before the second fire command can be received, forwarded or used and then flushed. Therefore, a complete command is not present.
5. Surface equipment access is controlled by password, and the fire command is controlled by dongle and password, prefix code, or pin code. Password, pin code and prefix code may be used to serve the same purpose. The password is at least a designated number of characters, e.g. at least eight (8) characters, long with upper, lower, and other characters allowed. If each fire command is accessed (deployed) by password, then prefix code or pin code may be omitted. If a fire command window is accessed by password, then a prefix code or pin code may be used to deploy the fire command.

In this example, there is no single action which enables sending a pre-fire or fire command simply by clicking a mouse button. Additionally, the dongle is used as a safety key and is not installed or used unless firing the guns. When firing the guns, the operator may install the dongle before sending the fire command. Each fire command relies on a password or pin code. If the operator attempts to send the fire command without the dongle installed, surface software requests installation of the dongle before continuing. By way of example, the request may be provided in a pop-up window.

Removal of the dongle during the time delay before the second fire command is provided should not prevent the second fire command from being sent. The operator may reinstall the dongle before sending the second fire command; or surface software may be used to request installation of the dongle before continuing. By way of example, the request may be provided in a pop-up window. For other operations, the dongle is removed. The surface command software freezes the program and prompts the user to remove the dongle for the various operations except firing the guns. By way of example, the user prompt may be provided in a pop-up window or equivalent.

The fire command protocol also may include the following numbered sections:

1. Each Fire Command starts with selected gun position (MODEM address) combined with a unique eFire serial number and a unique password. The password may be a predetermined number of character password, e.g. eight (8) character password; or a 2 to 4 digit prefix code or pin number that is entered by the operator. Passwords and prefix codes are not stored. Gun position may be default gun position if one gun is present but a valid serial number is entered or downloaded for the eFire to be used. The password may be at least eight (8) characters long with upper, lower, and other characters allowed. The first two and the last two characters can be used as prefix/pin codes to be combined with the fire command. If a password is not used, examples of easy prefix/pin codes that can be used and remembered for first fire command are 69d (0110 1001 bin) and for the second fire command are 96d (1001 0110) bin. In another embodiment, prefire and fire can be used as the prefix/pin codes where "pr" and "fi" are the code characters but the operator still types the full name.
2. To fire a gun, the combination of the gun position (MODEM address) and eFire unique serial number for each eFire used, and the prefix/pin code combined with the embedded fire code forms the unique fire command word in the surface equipment. The unique fire command word is transmitted then flushed from the command file. In this embodiment, if the prefix/pin code is not provided, the software does not know and cannot complete the fire command.

Another embodiment of the protocol employs a combination of the gun position (MODEM address) and eFire unique serial number for each eFire used, and the password combined with the embedded fire code forms the unique fire command word in the surface equipment. The unique fire command word is transmitted then flushed from the command file. In this case, if the password is not provided, the software does not know and cannot complete the fire command.

Another embodiment of the protocol employs a combination of the gun position (MODEM address) and eFire unique serial number for each eFire used, and the dongle ID combined with the embedded fire code forms the unique fire command word in the surface equipment. The unique fire command word is transmitted then flushed from the command file. In this case, if the dongle is not installed, the software does not know and cannot complete the fire command.

The protocol/communication software is configured to prevent single point failures such as a single software vector fault that would, if tripped, send fire commands. One way to prevent this is to make sure the machine does not have the complete fire command(s) stored in machine memory. Simply pressing a mouse button to send a fire command by default implies that the machine has the full fire command stored. The exception to this would be if the mouse button click causes the software to read the dongle ID and then generates the final fire command. This would solve the software issue but not the two action approach for the operator. The operator still uses some form of password.

At a minimum, if a mouse button function is used to send fire commands with password, either the password would have to be part of the fire command or the second fire command would have a different vector from the first fire command. This approach would prevent cascade (domino effect) failures. For example, the fire commands should not be placed in the same lookup table.

There are several ways to combine the password, prefix/pin code, or dongle ID with the final fire command. One simple form of combining the password or prefix/pin code with the final fire command is to either add or subtract the password or prefix/pin code from the fire command forming an incorrect or incomplete fire command. Then, when sending fire commands, the reverse process with password or prefix/pin code would have to be performed. By way of example, if using an eight (8) character password (and to keep it simple), two (2) characters of the password would have to be combined with each fire command. For example, the first two password characters may be used with prefire and the last two password characters may be used with fire.

The fire command protocol also may include the following numbered sections:

1. In mono-directional communication from surface to eFire, a delay from the first fire command to the second fire command may be a minimum of a desired number of minutes, e.g. 5 minutes. If communications occur with eFire during the 5 minute time delay, the first fire command is flushed and aborted. For bidirectional communication from surface to eFire and from eFire to surface, with eFire fire command word confirmed, a delay from the first fire command to the second fire command is a minimum of 5 minutes. After 5 minutes, a firing window may be opened, e.g. a firing window of 10 minutes, as the default value. (Time allocated for the firing window may be changed to fit the parameters of a given application, but the maximum widow time normally should not exceed 60 minutes.). The range of time may change because of the number of repeaters in the system. eFire flushes first fire commands at the end of the firing window if a second command is not received. For example, that would be 5 minute delay plus 10 minute window (or 15 minutes) before going safe. In case of a misfire, the time to wait before moving the gun string is the time delay plus firing window or 15 minutes in this example.
2. If a correct fire command is received within the allocated time frame, eFire executes the firing sequence provided minimum hydrostatic pressure parameters have been met for a predetermined time period, e.g. one (1) hour, and a set time delay has timed out. An abort function may be implemented during that delay but confirmation of abort may not be available with monodirectional communication. The operator should not move the gun string until the total number of delays has timed out or confirmation through bidirectional communication has confirmed the abort.

3. eFire does not directly store the fire commands in program memory but it can store received fire commands in static ram and "write only" history file.
4. Each eFire subroutine that accesses the fire command codes stored in temporary static ram has to modify the fire code by adding, subtracting, multiplying or dividing with a constant allowing just a one way trip through the logic. For example: Fire Command1 is stored in location 1. Fire Command1 is divided by Fire Command 2 and the result is stored in location 1. Location 1 is command word.
5. eFire decodes the fire command in partials so that no one subroutine or single compare can cause a fire condition. A simple or single compare is not be able to branch to a subroutine and fire; nor does the fire loop repeat over and over in case of a software or hardware problem.
6. A Read Out Port (ROP) does not accept and/or pass on a fire command to the eFire from surface interfaces. No firmware or software is written that allows a surface interface to transmit or eFire to receive a fire command through the ROP.
7. A Top Node MODEM that includes master, surface, floor, subsea or any other in-name MODEM that is directly connected to a PC is stored in control cabin; or the MODEM is either turned off or disconnected from the PC if the Top Node MODEM is on the working deck until all Fill-subs with wireless communication MODEMs are at least a predetermined depth, e.g. 200 ft., below ground or sea floor. As long as Fill-subs with MODEMs are not attached to gun strings, this does not apply.

A time for caution is when the guns are picked up and pushed into the hole and then the fill sub with MODEM-eFire is attached to the gun string. Another time for caution is when the guns are pulled out with Fill-sub /MODEM-eFire attached and guns not fired.

An example of a perforating gun deployment sequence is as follows:

1. Have Safety/HARC meeting before first pickup of tool string components
2. Push perforating guns into hole and hold with drill pipe slips at rotary table
3. Attach 10 ft. safety spacer, push into hole, and hold with drill pipe slips at rotary table
4. Hold Safety/HARC meeting before Fill-Sub with firing head is attached to guns
5. Declare wireless telemetry deactivated—OFF until guns are 200 ft. below surface or sea floor.
6. Clear deck of non-critical personnel
7. Attach Fill-Sub with firing head to safety tube
8. Push Fill-Sub with guns attached into hole
9. Activation of wireless telemetry allowed when guns are 200 ft. below surface or sea floor.
10. Allow non-critical personnel on deck
11. Install rest of tool string Depending on the application, embodiments described herein may be used with many types of perforating operations in a variety of wells and reservoirs. Specific components of the perforating gun assembly, telemetry system, and overall gun string may be adjusted according to the parameters of a given application. Similarly, various elements of the fire command protocols may be adjusted or interchanged to accommodate the specifics of a given perforation application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for perforating in a well environment, comprising:

deploying a perforating gun assembly downhole in a wellbore;

communicating with an electronic firing system associated with an electronic firing head in the perforating gun assembly; and using a fire command protocol to prevent unintended firing of a perforating gun of the perforating gun assembly while the perforating gun assembly is on surface or off depth, wherein the fire command protocol comprises two unique fire commands with a specified time delay between the first fire command and the second fire command to enable firing of the perforating gun of the perforating gun assembly.

2. The method as recited in claim 1, wherein communicating comprises communicating with the electronic firing system from surface equipment having a surface control system.

3. The method as recited in claim 1, wherein using comprises restricting storage locations of fire commands.

4. The method as recited in claim 1, wherein using comprises installing a dongle in surface equipment before firing the perforating gun.

5. The method as recited in claim 1, wherein using comprises initiating a firing command by providing a selected gun position and a unique electronic firing system serial number and pin code.

6. The method as recited in claim 1, wherein using comprises storing a firing command in static ram or in a "write only" history file.

7. The method as recited in claim 1, wherein using comprises using a timeout feature with respect to firing commands.

8. The method as recited in claim 1, wherein communicating comprises employing mono-directional communications.

9. The method as recited in claim 1, wherein communicating comprises employing bidirectional communications.

10. A perforating system comprising:

a perforating gun comprising an electronic firing head configured to receive commands from an electronic firing system;

a control system configured to deliver commands to the electronic firing system; and a telemetry system configured to convey commands between the control system and the electronic firing system, herein the electronic firing head is configured to initiate firing of the perforating gun only when two distinct firing commands are received within a predetermined period of time.

11. The perforating system of claim 10 wherein the telemetry system is a wireless acoustical telemetry system.

12. The perforating system of claim 11 wherein the wireless acoustical telemetry system comprises repeaters located along a tubing string in a wellbore.

13. The perforating system of claim 10 wherein the telemetry system is an electromagnetic telemetry system.

14. The perforating system of claim 10 wherein the electronic firing head is configured to confirm a state of the electronic firing head to the control system before firing the perforating gun.

15. The perforating system of claim 10 further comprising a safety key configured to interface with the control system to initiate a firing command.

16. A method comprising:

deploying a perforating gun assembly downhole in a wellbore;

communicating with an electronic firing system associated with an electronic firing head in the perforating gun assembly; and firing the perforating gun assembly upon receipt of a first fire command and a second fire command by the electronic firing system, wherein the first fire command is unique from the second fire command, and wherein firing the perforating gun assembly occurs when the first and second fire commands are received by the electronic firing system within a predefined time period.

17. The method of claim 16 wherein the first fire command is confirmed by the electronic firing system before the second fire command can be sent.

18. The method of claim 17 wherein input of a fire command requires installation of a dongle with surface equipment in operable communication with the electronic firing system.

* * * * *